US005134597A

United States Patent [19]

Bradt

[11] Patent Number: 5,134,597

[45] Date of Patent: Jul. 28, 1992

[54] ANIMATED KINETIC SCULPTURE DEVICE

[76] Inventor: Gordon E. Bradt, Rt. 2 Box 470, Eureka Springs, Ark. 72632

[21] Appl. No.: 659,833

[22] Filed: Feb. 22, 1991

[51] Int. Cl.[5] ..... G04B 19/06; A63H 1/06

[52] U.S. Cl. ..... 368/223; 368/229; 446/241

[58] Field of Search ..... 368/223, 229, 285, 179, 368/180, 76, 80; 446/241

[56] References Cited

U.S. PATENT DOCUMENTS

| | | | |
|---|---|---|---|
| 401,499 | 4/1889 | Junghans | 368/229 |
| 2,185,805 | 1/1940 | Feiner | 368/179 |
| 2,574,048 | 11/1951 | Marmor | 368/229 |
| 4,421,421 | 12/1983 | Bradt | 368/229 |

*Primary Examiner*—Vit W. Miska

[57] ABSTRACT

An animated kinetic sculpture device in the form of a pedestal for support of another kinetic sculpture or other object, or as a stand alone advertising piece. The device comprises a supporting structure, a motor driven upright cylindrical helical coil spring rotatably mounted to the supporting structure, a sliding and pivoting post adjacent to and generally parallel to the coil spring, an object, optionally in the form of a figure of a human, bushed to the sliding post, a lifter follower also bushed to the sliding post such that it can also pivot, the follower especially conformed to engage the rotating coil spring and to bear mainly on that side of the coil spring that will pull it into engagement, such that the follower and the object will be carried up the coil spring along the sliding post. An ejection piece at the top of the coil spring is provided to pivot the follower out of engagement so the object and follower may slide back down by gravity. An arrangement is provided at the bottom to re-engage the follower such that it and the object will rise again, and the cycle will automatically continue to be repeated.

20 Claims, 3 Drawing Sheets

ANIMATED KINETIC SCULPTURE DEVICE

FIELD OF THE INVENTION

This invention relates to a motor driven animation device to provide support to an object such as a kinetic clock sculpture, or as a stand alone advertising or kinetic sculpture piece.

OBJECT AND SUMMARY OF THE INVENTION

An object of the present invention is to provide an animated pedestal for a Kinetic clock sculpture such as the one depicted in my U.S. Pat. No. 4,421,421, and one that could be readily connected and driven by the power source within the kinetic clock sculpture that it is supporting. Other objects of the present invention are to achieve an attention getting mechanism that has interesting and intriguing action, and one that has a simple and reliable mechanism.

Another object of the present invention is to provide an animation device that could be employed in a variety of advertising applications.

The foregoing and other objects of this invention will be more fully understood from the following description of the illustrated embodiment thereof taken in conjunction with the accompanying drawings.

DETAILED DESCRIPTION

In accordance with the present invention, an animated device is provided as an intriguing and attention-getting pedestal, or for use as a mechanism in an advertising display.

Figure 1:
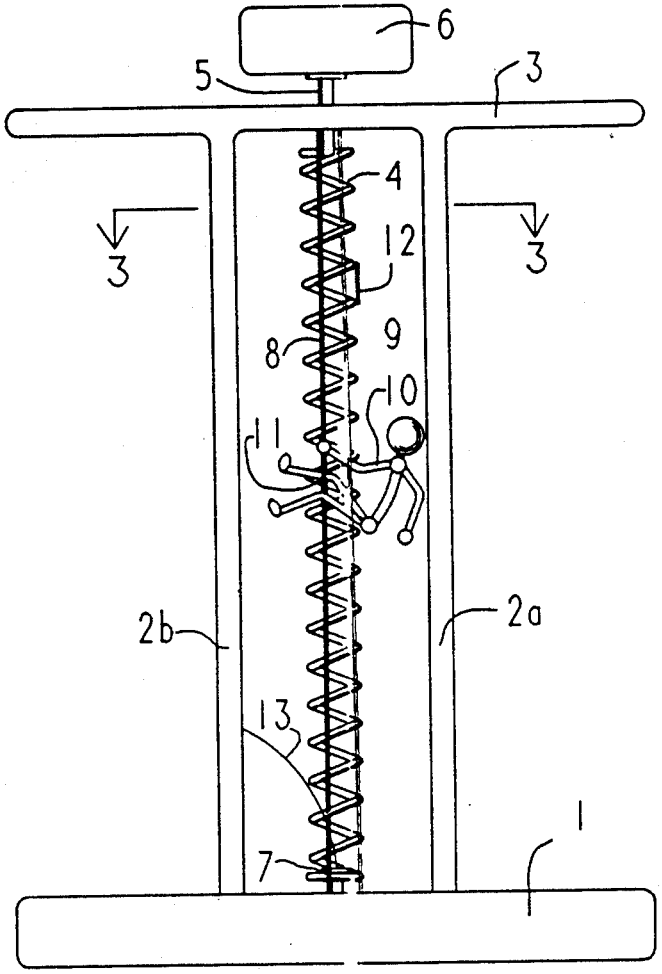
FIG. 1 is a front view of the entire device including the supporting structure in the form of the base, the vertical members in the form of column posts, the animation mechanism within the column posts, the top platform, and the power source. The cylindrical helical spring is rotated by the power source, and a mechanism connected to the spring carries the stick figure of a human, or other object, up the inside of the column, until at the top, the stick figure, or other object, is released to slide back to the bottom, where the mechanism is automatically re-engaged, thus causing the stick figure to climb up the column again.

In FIG. 1, the supporting structure is shown with the base 1 providing stability for the apparatus as well as a place to secure upright members in the form of four vertical column posts, the front column posts 2*a* and 2*b* being shown, and a place to secure mechanism components 7, 8, 9, and 10 that will be described later.

A platform 3 is secured to the top of the vertical column posts 2*a, b, c,* and *d*, and provides for mounting a kinetic sculpture clock or other object. A right hand wound cylindrical helical spring 4 is connected to, and driven by, a shaft 5 that is rotating at about 20 R.P.M. in a clockwise direction as you look down on the spring from above.

The shaft 5 is driven by a power source 6. The power source 6 is shown diagrammatically since it may be connected directly as shown, or may be part of a separate kinetic clock sculpture and therefore be remotely driving the shaft 5 through a series of gears and linkages.

At the bottom end of the coil spring 4 is a thrust bearing assembly 7, that provides a rotatable mount for the coil spring 4 and also provides a slight stretching extension of the spring so as to keep it in a taught and straight configuration from top to bottom.

A sliding and pivoting post 8 and upright member 9 are located in front of coil spring 4 and secured to the base 1 at the bottom and to the platform 3 at the top. The sliding and pivoting post 8 provides for an object in the form of a stick FIG. 10 to be connected to a mechanism assembly 11 that moves the stick FIG. 10 up and down the column as will be described in detail in FIG. 2 and 3. The guiding post 9 prevents the stick FIG. 10 from twisting around and may be used to slow its descent, as will be described later.

An obstruction in the form of an ejection bar 12 is attached to the upper coils of the spring 4 and serves to cause the release of the mechanism assembly 11 and allow the stick figure 10 to slide back to the bottom where the cam piece 13 causes the mechanism 11 to re-engage and cause the stick FIG. 10 to start climbing again. This will be described in more detail in the review of FIGS. 2 and 3.

Figure 2:
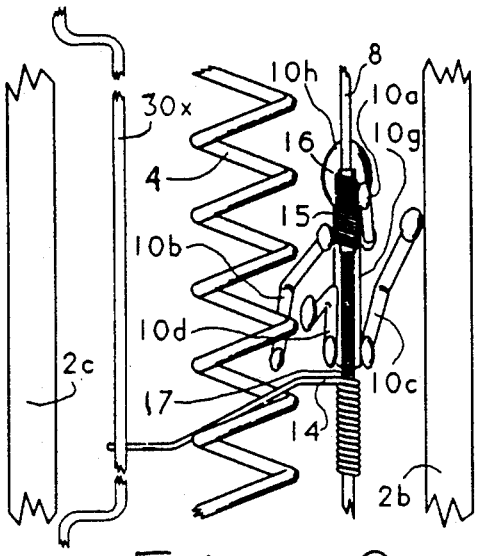
FIG. 2 is a double sized side view of a portion of the FIG. 1 pedestal column, showing the details of the mechanism.

FIG. 2 is a double sized side view of a portion of the FIG. 1 pedestal showing sections of the left column posts 2*b* and 2*c* and a portion of the coil spring 4 and a portion of the sliding and pivoting post 8. All parts of the stick FIG. 10 are shown; its left arm and hand 10*a*, right arm and hand 10*b*, left leg 10*c*, right leg 10*d*, its body 10*g*, and its head 10*h*.

The most important component of the mechanism is the sliding follower 14, which consists of a coil that fits loosely around the sliding and pivoting post 8 so as to slide easily up and down, and the follower arm, which is an extension of the coil and angles down across the spring 4 at a slightly greater angle than the pitch of the coil spring 4. This angle is vital, so that the follower bears mainly on the back side of the coil spring. Since the coil spring 4 is a right hand wound spring and is rotating in a clockwise direction as viewed from the top, the back of the coil spring 4 is moving from left to right when viewed from the front, the follower 14 is therefore constantly being pulled to the right and into engagement with the spring 4, and will not slip away as it rides up the coil spring 4 from bottom to top. If the follower 14 is bent at an angle too close to horizontal so as to bear significant pressure on the front part of the coil spring 4, which is moving from right to left, the follower 17 will not stay in engagement as it rides up the coil unless it is held in engagement by some trapping means.

One trapping means, but less desirable because it adds an extra component and frictional wear, would be to place a vertical trap piece 30*x* that would be located to catch the tip of the follower 14 as it is moved into engagement at the bottom, and continue up the back of the column to the point where the follower 14 is supposed to be released. The vertical trap piece 30*x* is bent away to the back at that point so that the tip of the follower would no longer be trapped and thus would be released.

Above the follower 14 is a teflon bearing tube 16 encased in a wound coil 15. This coil may be wrapped around the teflon tube 16 under tension so as to provide a bite and positive hold on the teflon tube in spite of its very slippery friction component. The coil 15 is then tinned with solder or otherwise encased to make the coil rigid. An alternative to the coil 15 could be a thin wall metal tube.

The stick FIG. 10 is attached to the coil 15 through the stick figure's hand 10*a*. A relatively light weight compression spring 17 is placed in between the teflon tube 16 and the follower 14. Since most of the mass of the falling mechanism is in the stick figure, the compression spring 17 cushions the stop when the follower 14 is brought to a stop at the bottom of the column. The follower 14 is not connected to the compression spring 17, which in turn is not connected to the teflon tube 16 above it. They all slide and pivot independently on the post 8, and this will be reviewed in more detail in the description of FIG. 3.

Figure 3:
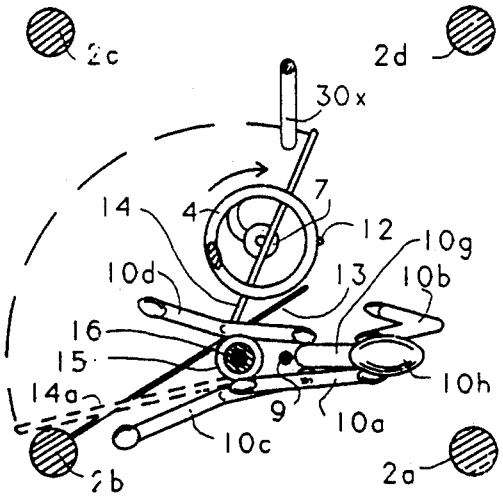
FIG. 3 is a double sized top view of the FIG. 1 pedestal column taken from the A Section line and below, and showing the mechanism as it is engaged for climbing up the column, and as dotted lines, being disengaged so as to fall back to the bottom of the column.

FIG. 3 is a double sized top view of a section of the pedestal column taken from the section line A shown in FIG. 1. First, the follower 14 is in the position of engagement with coil spring 4 and since it is bearing primarily on the back side of the coil, it will tend to be pushed to the right and therefore stay in engagement. The dotted lines of 14*a* show the same follower out of engagement with the coil spring 4 and all the way against the vertical column 2*b* which serves as to limit the counter clockwise pivot of the follower 14.

The follower 14 is kicked out of engagement when it climbs the rotating coil spring 4 and reaches the ejection bar 12 which then kicks the follower 14 to the left and out of engagement, thus allowing the follower 14 to fall back to the bottom.

When the follower 14 reaches the bottom it will strike somewhere along the angled cam piece 13, which will push the follower 14 to the right and back into engagement with the coil spring 4. Since the cam piece 13 takes the initial impact of the falling follower 14, it is be made of small diameter spring steel so as to flex so as to help cushion and quiet the impact.

The final stopping and reversing of the direction of the follower 14 will occur when it goes into full engagement with the coil spring 4. The follower 14 pivots and slides independently of the stick FIG. 10 which is attached through the coil 15 to the teflon tube 16. The stick figure's fall may be slowed by the friction of the teflon tube 16 on the sliding and pivoting post 8, so the follower 14 will may have already engaged with the coil spring 4 and started its ascent when the stick FIG. 10 reaches the bottom. This is where the light weight compression spring 17 comes into play and absorbs part of the falling mass and change of direction of the stick FIG. 10.

The upright member 9 might not be needed if the stick figures' right leg 10*d* is moved out in close proximity to the left side of the coil spring 4 at around an eight o'clock position and its right arm 10*b* is arranged to be close to the right side at about four o'clock. As the stick FIG. 10 moved up and down its right arm and leg would keep it in reasonably parallel alignment to the front of the pedestal. However, as the stick FIG. 10 falls, the arm 10*b* and leg 10*d* brushing against the coils of coil spring 4 can make excessive noise which may be irritating since the cycle is repeated so frequently.

Therefore, the upright member 9 is employed to keep the stick FIG. 10 in alignment by bearing against the inside of its legs when it starts to twist away from being parallel to the front.

An important purpose of upright member 9 can be to serve to dampen or slow down the lower part of the descent of the stick FIG. 10. This is accomplished by biasing or spreading the lower end of guiding post 9 slightly away from sliding and pivoting post 8 so that upright member 9 is not parallel to sliding and pivoting post 8, but rather is closer at the top than at the bottom. The stick FIG. 10 then is positioned so that, at the bottom, the stick figures' crotch bears against the upright member, deflecting it slightly. This serves to slow the descent of the stick FIG. 10 as it nears the bottom, but since the upright member 9 is relatively flexible, having a small diameter in relation to it's length, the stick FIG. 10 does not reach a binding condition to the extent that it would stop before reaching the bottom, and it would still be reasonably free to be pushed back up the sliding and pivoting post 8.

An optional guide member in the form of a vertical trap piece 30*x* is shown from above in FIG. 3, with the front part of the piece keeping the follower 14 in engagement with the coil spring 4 except at the top and bottom of the travel.

Rather than the use of the ejection bar 12 to push the follower 14 out of engagement at the top, an alternative upper diagonal cam piece, similar to the cam piece 13 at the bottom, could be located at the top and back so as to push the tip of the follower 14 out of engagement. However this is considered to be a less desirable option because it would be a much larger piece and have to be more carefully positioned. It is therefore not shown in the drawings to enhance clarity.

Figure 4:
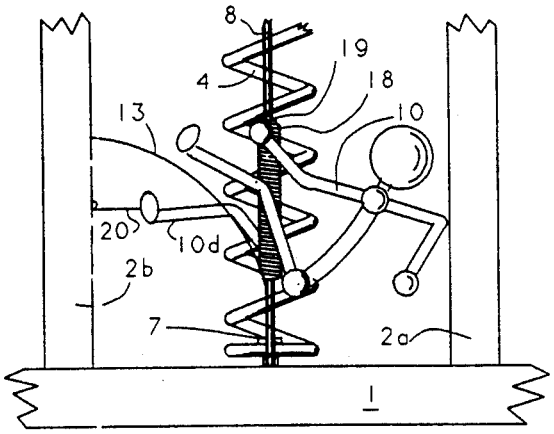
FIG. 4 is a double sized partial front view of a simplified version.
Figure 5:
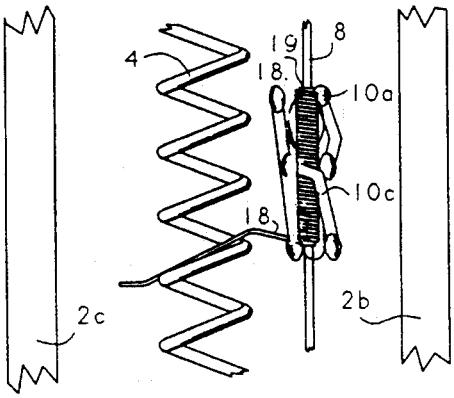
FIG. 5 is a double sized partial side view of that simplified version.
Figure 6:
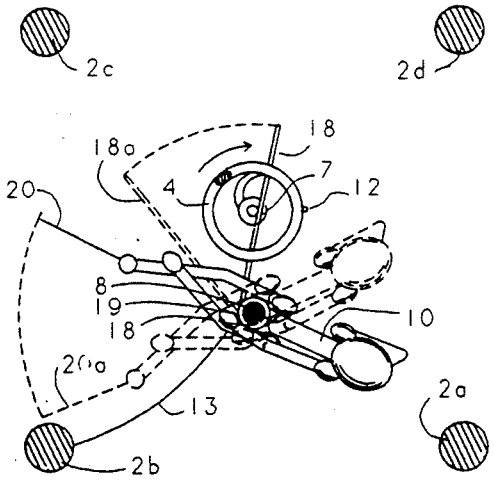
FIG. 6 is a double sized top view of that simplified version.

A simplified version of the animated pedestal could be employed and is shown in FIG. 4, 5, and 6. This simplified and more compact version would be advantageous if the stick figure or other object has a light enough mass, and/or the impact noise of the object coming to a stop at the bottom is not objectionable, and there is enough room between the column posts for the object to rotate up to about 25 degrees away from parallel to the front of the pedestal, and the rotating of the object away from parallel to the front during the rising and falling phase is acceptable. First in FIG. 4, this simplified version would attach the stick FIG. 10, or other object, directly to the front of a slightly different follower and coil 18 combination. This version would eliminate the compression spring 17 and the wound coil 15, that were in the previous FIG. 2 and 3. The teflon bearing tube 16 would also be replaced by similar teflon bearing tube 19 and would be encased inside the follower and coil 18.

Also in FIG. 4, the cam piece 13, is again shown as a relatively small diameter spring steel that will deflect on impact so as to cushion and quiet the action. Note that the stick figure's leg 10*c* instead of the follower will now strike the cam piece 13 causing the assembly, including follower 18, to rotate clockwise back into engagement with the coil spring 4.

FIG. 4 also shows a portion of the base 1, the lower portion of the column posts 2*a* and 2*b*, and the sliding and pivoting post 8.

Another element of the simplified version is the stop tab 20. This stops the counter clockwise rotation of the stick figure 10 as is falling so as not to allow its right hip, arm or shoulder to strike against the spring coils 4 as it falls. This takes the place of the previously used guiding post 9. This tab stop 20 could also be some other extension of the assembly such as an extension of follower 18 so as to stop against some other vertical member such as 2*c*.

FIG. 5 is a left side portion of the simplified version showing the stick figure's left hand 10*a* and left leg 10*c* secured to the follower coil 18, and the follower 18 in engagement with the spring coil 4.

FIG. 6 shows a top view. First, with solid lines, the stick FIG. 10 and follower 18 are in engagement with coil spring 4, this being caused by the stick figure's left leg coming against cam piece 13 causing it to rotate clockwise to pivot the follower 18 back into engagement so as to climb up the coil spring 4.

The dotted lines indicate the stick figure and follower 18*a* rotated in the counter clockwise mode by the ejection piece 12 at the top of the coil spring 4, thus moving the follower arm 18*a* out of engagement with coil spring 4 thus allowing the assembly to fall back to the bottom.

The sliding and pivoting post 8, the teflon tube 19, and the follower coil 18, the column posts 2*a, b, c,* and *d* are also shown. Also the tab stop 20 and 20*a* are shown in the two positions.

Figure 7:
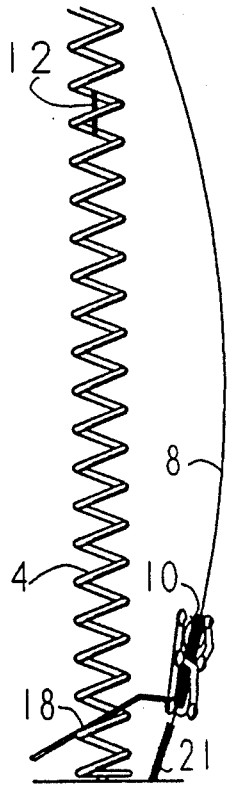
FIG. 7 is an abbreviated side view of a modification to the simplified version and in the same scale as FIG. 1.

FIG. 7 shows a variation of the simplified version that as shown in FIG. 4, 5, and 6. FIG. 7 is an abbreviated side view in which the cam piece 13 is replaced by a cushioning means in the form of a light compression spring 21 which can be much more effective in cushioning and quieting the impact of the falling stick figure or other object. Also since the cam piece is not there to push the stick figure's leg 10*c* so as to rotate the assembly back into engagement, another means must be employed.

That other means is to bend the sliding and pivoting post 8 so that it is in a bowed shape and is tilted away from the vertical at the bottom. This non vertical angle allows gravity to pull the heavier side of the stick FIG. 10 down and clockwise so as to pivot the follower 18, along with the assembly, into engagement with the coil spring 4. By bowing the sliding and pivoting post 8, the post can be away from vertical at the bottom to allow gravity to cause engagement, and yet still remain in reasonable proximity along the length of the coil spring 4 so as to provide its guiding function from top to bottom.

Even with the bowed shape and deviation from vertical of the sliding and pivoting post, the angle of the follower 18 still remains such that its major pressure is on the back side of the coil spring 4 throughout its travel from bottom to top, so that the follower 18 will stay in engagement once it enters into engagement at the bottom until it is pushed out of engagement at the top by the cam bar 12.

I claim as my invention:

1. An animation device, comprising a supporting structure, an upright cylindrical helical coil spring rotatably mounted to said supporting structure, a motor driving means to rotate said coil spring in the direction that would provide lift, an upright sliding and pivoting post mounted to said structure, adjacent to and generally parallel to, said coil spring, an object with an accompanying follower bushed to said sliding and pivoting post, wherein said follower when pivoted into engagement with said rotating coil spring will lift itself and said object up the length of said coil spring, an ejection means for disengaging said follower at the top of said coil spring to allow said object and its follower to return by gravity along said sliding and pivoting post to the bottom of said coil spring, a re-engagement means at the bottom of said coil spring to bring said follower back into engagement with said coil spring, said follower being conformed to bear its primary lifting force on that side of said coil spring that is moving into the direction of engagement of said follower, wherein said follower will be pulled into engagement with said coil spring and will remain in engagement throughout its travel up said coil spring until it is pushed out of engagement by said ejection means, whereby the object automatically rises and falls in a cyclical manner.

2. The device as defined in claim 1, wherein said ejection means comprises a bar or other obstruction attached an upper coil of said coil spring, whereby as said follower climbs up said coil spring and reaches the location of said ejection means, the rotation of said ejection means pushes said follower out of engagement with said coil spring.

3. The device as defined in claim 2, wherein said object and said follower are connected so as to slide up and down and to pivot to the right and left as a unit.

4. The device as defined in claim 3, wherein said sliding and pivoting post comprises a bent or bowed shape of said post such that it slants away from vertical at its bottom, and said object is weighted to one side such that at the bottom of its travel it will rotate or pivot to bring the object's heavy side down so as to also pivot said follower back into engagement with said coil spring so as to provide the re-engagement means.

5. The device as defined in claim 3, wherein said re-engagement means comprises an angled cam piece attached to said supporting structure near the bottom of said coil spring, positioned to engage either said object or said follower as they slide to the bottom, and to push and pivot said follower back into engagement with said coil spring.

6. The device as defined in claim 3, comprising a cushioning means such as a compression spring that slides on said sliding and pivoting post and rests at the bottom so as to engage said object at the bottom of its fall so as to cushion and quiet the impact.

7. The device as defined in claim 1, wherein said object comprises a figure in human form.

8. The device as defined in claim 1, wherein said coil spring is rotatably supported at each end in a stretched condition so as to enhance its straightness and rigidity.

9. The device as defined in claim 1, wherein said supporting structure has vertical members that serve as containment guides for the object or follower means in their movement up or down.

10. The device as defined in claim 9, wherein said object and said follower are not connected and may slide and pivot independently on said sliding and pivoting post, and wherein guiding means are provided to prevent said object from pivoting while it is sliding on said sliding and pivoting post.

11. The device as defined in claim 10, wherein guiding means comprise tabs or extensions of the said object or said follower that will stop against said vertical members, whereby the rotation of the object or follower is limited during their travel up and down.

12. The device as defined in claim 10, comprising a biased flexible upright member that provides limits for pivoting of the object, but is also not parallel to said sliding and pivoting post, being farther from said post at the bottom than at the top, and comprising a tab or extension of said object that is configured to encompass and bind against said biased flexible upright member as said object slides towards the bottom, whereby the binding condition slows down the descent of said object and reduces its impact at the bottom.

13. The device as defined in claim 10, comprising a compression spring threaded onto said sliding post between said object above and said follower below, whereby the mass of the falling object is cushioned and quieted by the compression spring as they come to a stop at the bottom.

14. The device as defined in claim 1, wherein said ejection means comprises an angled piece attached to said supporting structure and located near the top of said coil spring and in such a position that the rising follower means will strike said angled piece and pivot said follower means out of engagement with said coil spring.

15. The device as defined in claim 1, comprising a vertical guide member located and conformed serve as a vertical trap piece to trap said follower, or its extension, after said follower has entered into engagement with said coil spring at the bottom, and continue to keep said follower in engagement until just before said follower reaches said ejection means at the top.

16. The device as defined in claim 1, wherein said supporting structure comprises a pedestal for mounting and display of another object whose motor driving means is also used to drive the rotation of said coil spring.

17. An animation device, comprising a supporting structure, an upright cylindrical helical coil spring rotatably mounted to said supporting structure, a motor driving means to rotate said coil spring in the direction that would provide lift, an upright sliding and pivoting post mounted to said structure, adjacent to and generally parallel to, said coil spring, said sliding and pivoting post in a bowed configuration such that it slants away from vertical at its bottom, an object with an attached follower bushed to said sliding and pivoting post, wherein said follower when pivoted into engagement with said rotating coil spring will lift itself and said object up the length of said coil spring, an ejection means in the form of a bar or obstruction affixed to an upper coil of said coil spring for disengaging said follower by pivoting it out of engagement to allow said object and its follower to return by gravity along said sliding and pivoting post to the bottom of said coil spring, said object weighted to one side such that at the bottom of said sliding and pivoting post that is slanted away from vertical, gravity will pivot the weighted side down to bring said follower back into engagement with said coil spring, said follower being conformed to bear its primary lifting force on that side of said coil spring that is moving into the direction of engagement of said follower, wherein said follower will be pulled into engagement with said coil spring and will remain in engagement throughout its travel up said coil spring until it is pushed out of engagement by said ejection means, a compression spring or other cushioning means located at the bottom of said sliding and pivoting post to cushion and quiet the impact of the falling object, whereby the object automatically rises and falls in a cyclical manner.

18. The device as defined in claim 17, wherein said coil spring is rotatably supported at each end in a stretched condition so as to enhance its straightness and rigidity.

19. The device as defined in claim 17, wherein said object comprises a figure in human form.

20. The device as defined in claim 17, wherein said supporting structure comprises a pedestal for mounting and display of another object whose motor driving means is also utilized to drive the rotation of said coil spring.

* * * * *